US006411568B1

(12) United States Patent
Logan

(10) Patent No.: US 6,411,568 B1
(45) Date of Patent: Jun. 25, 2002

(54) TIMEPIECE FOR AUTOMATICALLY DISPLAYING TIMES WITH INTERMITTENT FAST SETTINGS TO ENCOURAGE PUNCTUALITY

(76) Inventor: James D. Logan, 81 Castle Hill Rd., Windham, NH (US) 03087

( * ) Notice: Subject to any disclaimer, the term of this patent is extended or adjusted under 35 U.S.C. 154(b) by 0 days.

(21) Appl. No.: 09/650,443

(22) Filed: Aug. 29, 2000

(51) Int. Cl.[7] ..... G04B 47/00
(52) U.S. Cl. ..... 368/10; 368/223
(58) Field of Search ..... 368/10, 223, 72, 368/75

(56) References Cited

U.S. PATENT DOCUMENTS 5,386,398 A * 1/1995 Hiemke et al. ..... 368/10

* cited by examiner

*Primary Examiner*—Bernard Roskoski
(74) *Attorney, Agent, or Firm*—Charles G. Call

(57) ABSTRACT

A timepiece including means for intermittently changing the indicated time of day to an intentionally fast setting to discourage tardiness. The timepiece, which may be a wristwatch, pocket watch-or clock, computer clock, or any other time of day indicator, intermittently displays a time of day which is several minutes fast to encourage punctuality. The duration of the intentionally introduced time of day error, as well as the times when that error is intermittently introduced, may be cyclically and/or randomly varied so that the person who consults the timepiece does not know whether the timepiece, at any particular time, is fast or on-time. The days, and the time period(s) during each day, when the fast settings are introduced may be programmed so that the timepiece accurately indicates the time of day except at times when promptness is particularly important.

10 Claims, 2 Drawing Sheets

TIMEPIECE FOR AUTOMATICALLY DISPLAYING TIMES WITH INTERMITTENT FAST SETTINGS TO ENCOURAGE PUNCTUALITY

FIELD OF THE INVENTION

This invention relates to chronometers for displaying the time of day and more particularly to timekeeping methods and apparatus for discouraging tardiness.

BACKGROUND OF THE INVENTION

Many people have great difficulty being "on time" for scheduled appointments and meeting deadlines. To encourage punctuality, such people often intentionally set their clocks ahead by a short interval, say ten minutes, in the hope of being more nearly on-time even when the timepiece indicates that they are "late." Unfortunately, this practice is often be self-defeating: since the timepiece is known to have been intentionally advanced, it is disregarded, particularly when the person is heavily distracted by current tasks which are perceived to be important.

SUMMARY OF THE INVENTION

It is therefor an object of the present invention to encourage punctuality.

As contemplated by the invention, means-are incorporated into a timepiece, such as a wall clock, alarm clock or wristwatch, for indicating a time of day which is normally ahead of the actual time by an intentionally added error interval, but which intermittently indicates approximately the correct time of day. For example, an electronic wristwatch might display a time of day ten minutes ahead of actual time for 23 minutes, and then display approximately correct time for 5 minutes. While the wearer would be aware that the watch normally runs ten minutes fast, the wearer would also be aware that the watch may not be fast but rather be on time when its consulted. In this way, the wearer is discouraged from ignoring the watch's admonition to be on time.

The magnitude of the intentionally introduced error interval, as well as its duration and its timing, may be randomized. For example, the timepiece may be advanced in a sequence of cycles such that, during each cycle, a random error is introduced so that the time piece runs fast by an error interval having a duration between 5 and 15 minutes, the period during which the timepiece runs fast is a random period lasting from 10 to 30 minutes, and the interval in each cycle during which the time piece displays approximately the correct time may vary randomly from one to eight minutes. By randomizing the magnitude of the introduced time error, and varying the timing at which that error is introduced, the wearer is unable to know, at any given time, whether and by how much the timepiece may be running fast, and hence is discouraged from ignoring the indicated time.

The principles of the invention can be applied to particular advantage to an alarm clock. Frequently, people who have difficulty rising on time in the morning set their alarm clocks to run fast in an effort to get up on time. Knowing the clock is actually fast, however, the user is encouraged to remain in bed. By introducing a random or intermittent time error, however, the user can no longer depend on the knowledge that the clock is set fast, and is hence encouraged to rise promptly.

If desired, the introduction of fast settings may be disabled on predetermined days or during predetermined times of day. For example, a business person may set the watch to run accurately at all times except during business hours (9:00 am to 5:00 p.m., Monday through Friday) when fast running intervals are intentionally introduced on an intermittent basis.

These and other objects, features and advantages of the invention will be better understood by considering the following detailed description of a preferred embodiment of the invention. In the course of this description, frequent reference will be made to the attached drawings.

DETAILED DESCRIPTION

Figure 1:
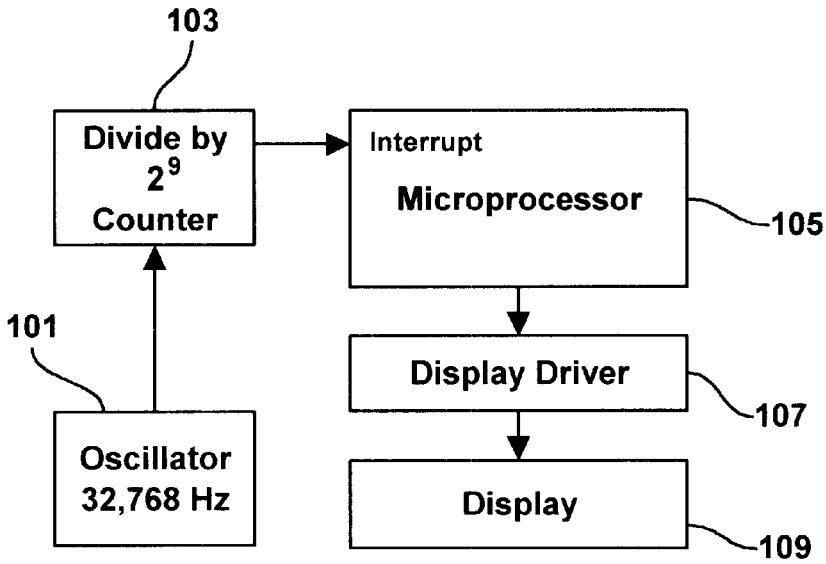
FIG. 1 is a block diagram illustrating the principle components of a conventional electronic timepiece of a type that can be readily modified to incorporate the principles of the invention.

The principles of the present invention may be exploited using both analog and digital timepieces, but may be most readily incorporated into a conventional microprocessor controlled electronic timepiece of the type illustrated in FIG. 1. In that arrangement, an oscillator 101 produces time varying output signal at a high frequency (e.g. 32,764 hertz) established by a quartz crystal. The high-frequency output of the oscillator 101 is fed to a counter circuit which divides the frequency by 512 ($2^9$) to yield a train of output pulses having at 64 Hz. This lower frequence signal is applied to an interrupt input of a microcontroller which is programmed to count the incoming pulses and produce decimal data indicating the hours, minutes and seconds of a current time of day which are provided via a display driver 107 to an LCD display 109. A prior electronic watch employing a programmable processor of the type shown in FIG. 1 is described in detail in U.S. Pat. No. 4,995,020 which issued to Ross E. Mitchell on Feb. 19, 1991, the disclosure of which is incorporated herein by reference.

Figure 2:
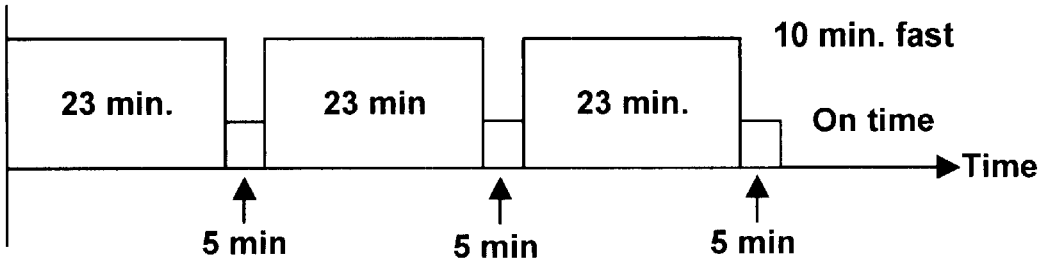
FIG. 2 is a timing chart indicating the manner in which a timepiece of the type contemplated by the invention may introduce an intentional error in the indicated time of day on a timed, periodic basis.

As contemplated by the present invention, an error value is intentionally and intermittently introduces so that displayed time of day is normally set ahead by an error interval of, say, ten minutes. Thus, the timepiece normally runs 10 minutes fast. Periodically, however, the time displayed is reset to approximately the correct time of day. As illustrated in the example of FIG. 2, the timepiece is set to display a time of day ten minutes after the correct time of day for an interval of 23 minutes. For example, during this interval, if the actual time of day is 2:50 p.m., the timepiece would display 3:00 p.m. This 23 minute long fast setting interval is followed by an interval of five minutes when the timepiece shows the correct time. Because the cycles repeat at different times during the hour, a person who consults the timepiece cannot easily determine whether the timepiece is set ahead or set to correct time, and hence must assume that it may accurately indicate the time even though it is set ahead most of the time.

Figure 3:
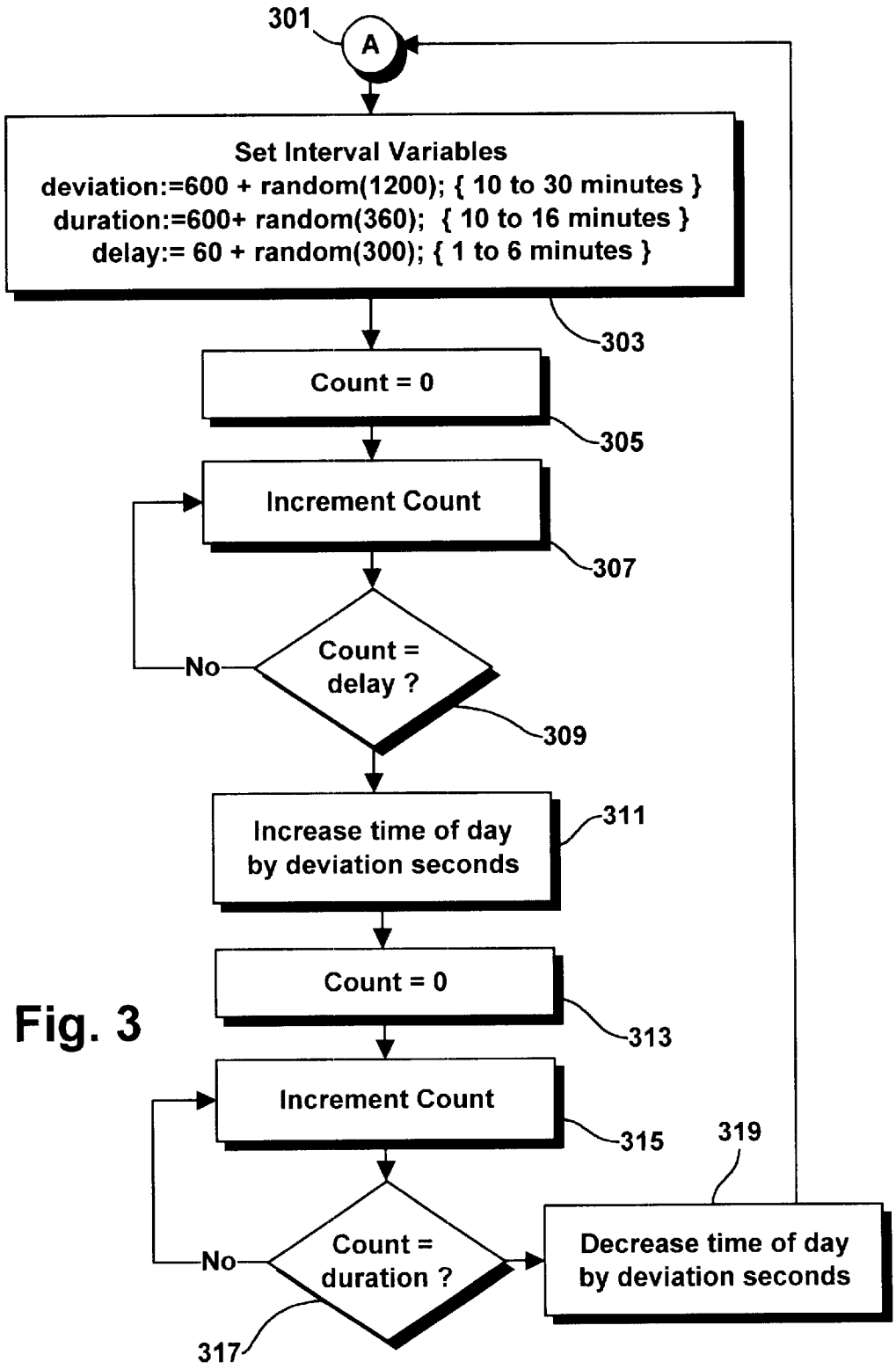
FIG. 3 is a flow chart illustrating the manner in which a conventional electronic timepiece employing a control microcontroller may be programmed to introduce a time indication error having a randomly determined error magnitude which lasts for a randomly determined duration and which is followed by period of random duration during which the timepiece accurately indicates the time of day.

To discourage the user from making an assumption that the watch is probably fast and hence disregarding its setting, the amount of the error and its timing may be totally randomized. FIG. 3 of the drawings presents a flow chart illustrating the manner in which an electronic timepiece incorporating a microprocessor (as illustrated in FIG. 1) can be programmed to introduce the randomized, intermittent settings. Each cycle begins at the start entry point seen at 301 in FIG. 3. At the start of each cycle, three different random timing parameters are generated using a standard random number generating subroutine which accepts, as an input parameter, a "range" integer value and produces an result random integer value in the range from 0 to range. As indicated by the step at 303, the interval value "deviation" is set to an integer value between 600 and 1,800 seconds (10 to 30 minutes); the value "duration" is set to an integer value between 600 and 960 seconds (10 to 16 minutes); and the value "delay" is set to an integer value between 60 and 360 seconds.(1 to 5 minutes).

After the random variables have been set, the value "count" is initialized to zero as seen at 305. The microprocessor then counts timing pulses at one second intervals (which may, for example, be produced by counting the 64 hz. timing signals from the crystal oscillator which are applied to the microprocessor's interrupt input as shown in FIG. 1), incrementing "count" each second by one at 307, until the count value equal to the random value "delay" is reached one to five minutes after each cycle begins. At the end of the delay interval, the time of day value displayed by the timepiece is increased by the number of seconds indicated by the random value "deviation"; that is, by an error duration between 600 and 1800 seconds (10 to 30 minutes) as indicated at step 311.

As indicated at steps 313–317, the length of time during which the fast setting is maintained is determined by counting one second intervals until the random value "duration" is reached 600 to 960 seconds (10 to 16 minutes) after the fast setting is applied. When "count" reaches the "duration" value, the time of day setting of the watch is decreased by "deviation" seconds as indicated at step 316 to return the timepiece to its normal, accurate setting, and the cycle resumes at 301.

If desired, the time of day and day of the week during which the fast settings are introduced may be controlled by the same time mechanism. In this way, the fast settings may be introduced only when needed. For instance, if a person wanted to get back from lunch earlier each day, the watch could speed up during the lunch hour, but in a random fashion, so that the user would have to leave earlier to be sure he/she wasn't late for the post-lunch meeting. In addition, the amount by which the timepiece is set ahead my be varied in accordance with external conditions; for example, in recognition that a traveler is more likely to be late during the morning and evening "rush hour" when traffic delays can be expected.

If desired, the parameters determining the amount and timing of the intermittently introduced fast settings may be preset, or the timepiece may be programmable, either by pressing one or more buttons on a watch case, setting dials on a clock, or keyboarding information of a computer which is then downloaded into the timepiece to set the parameters. The timing parameter data may be downloaded from a personal computer to the wristwatch using an infrared data link of the type employed in the electronic reminder watch described in U.S. Pat. No. 6,075,755 which issued to David Zarchan on Jun. 13, 2000.

In the arrangements described above, the time setting changes occur abruptly. If desired, the same effect may be achieved by changing the time keeping speed of the timepiece, so that it runs fast for a time until a predetermined deviation duration from the actual time of day is reached, whereupon the time piece runs more slowly until the deviation duration decreases to reach substantially the correct time of day. In a electronic watch, the "movement" may be slowed by stealing cycles (deleting timing pulses) before they are counted, and may be made to move more rapidly by introducing additional pulses into before counting.

The introduction of intermittent timing deviations can be adaptive. The invention may be incorporated into an alarm watch, for example, which signals when attention to a particular task is needed. When the wearer actually attends to the task (possibly later), he or she presses a button on the watch to acknowledge the alarm and confirm that the scheduled activity has been attended to. When on-time performance is achieved, the watch indicates accurate time; however, when delays in performance are experienced, the watch automatically introduces a fast setting to compensate for the late behaviour. To prevent the feedback mechanism from over-reacting, the amount of delay can be accumulated in a rolling average which is then used to determine the amount by which the timepiece is set ahead. In this way, the system could learn what type of error distributions would work best in keeping the user "in the dark" and not out-guess the system.

The timepiece contemplated by the invention may further incorporate an override mechanism that would permit the user to determine the correct time if necessary. Some inconvenience in obtaining the accurate time is desirable, however. To achieve this, for example, the user may be required to press a button multiple times within a given time limit in order to override the fast setting. To prevent habitual reliance on the override, the user could further set the timepiece so that accurate readings could only be accessed a limited number of times in a certain time period.

The invention can be used to particular advantage in connection with a Personal Digital Assistant or similar calendar system which incorporates or controls the timepiece. The PDA can be programmed to automatically introduce a fast setting into the timepiece when upcoming meetings are scheduled, and adjust the amount of the deviation based on the priority or importance assigned to the scheduled activity on the calendar.

Note also that, in a timepiece with programmable fast settings, another person who is aware of the propensities of the user for being late may set the timing and amount of the deviations without the knowledge of the user.

It is to be understood that the methods and apparatus which have been described are merely illustrative applications of the principles of the present invention. Numerous modifications may be made by those skilled in the art without departing from the true spirit and scope of the invention.

What is claimed is:

1. The method of encouraging punctuality consisting of the step of automatically and intermittently changing the time setting displayed by a timepiece between a substantially on-time setting and a fast setting.

2. The method set forth in claim 1 wherein the timing of said on-time and fast settings is predetermined.

3. The method set forth in claim 1 wherein the timing of said on-time and fast settings is randomized.

4. The method set forth in claim 1 including the further step of inhibiting said intermittent changing at predetermined times.

5. A timepiece for encouraging punctuality including, in combination, timing means for generating signals establishing alternating fast-setting and normal-setting time periods, and display means for indicating the actual time of day during said normal-setting periods and for indicating a time of day during said fast-setting periods which is later that the actual time of day by a deviation duration, whereby a person viewing said display means is encouraged to perform tasks earlier during said fast-setting periods.

6. A timepiece as set forth in claim 5 wherein said fast-setting periods have a longer duration than said normal setting periods.

7. A timepiece as set forth in claim 5 including means for randomizing the duration of said fast-setting periods.

8. A timepiece as set forth in claim 5 including means for randomizing the duration of said normal-setting periods.

9. A timepiece as set forth in claim 5 including means for randomizing the magnitude of said deviation duration.

10. A timepiece as set forth in claim 5 wherein the timing of said fast-setting time periods is programmable by the user.

* * * * *